US009301039B2

(12) United States Patent
Brunner et al.

(10) Patent No.: US 9,301,039 B2
(45) Date of Patent: Mar. 29, 2016

(54) HEADPHONE

(75) Inventors: Robert Brunner, San Francisco, CA (US); Kenny Sweet, San Francisco, CA (US); Gregoire Vandenbussche, San Francisco, CA (US); Chris Fruhauf, San Anselmo, CA (US)

(73) Assignee: Apple Inc., Cupertino, CA (US)

( * ) Notice: Subject to any disclaimer, the term of this patent is extended or adjusted under 35 U.S.C. 154(b) by 393 days.

(21) Appl. No.: 12/972,476

(22) Filed: Dec. 19, 2010

(65) Prior Publication Data

US 2011/0206216 A1 Aug. 25, 2011

Related U.S. Application Data

(60) Provisional application No. 61/292,159, filed on Jan. 4, 2010.

(51) Int. Cl.
*H04R 25/00* (2006.01)
*H04R 1/10* (2006.01)

(52) U.S. Cl.
CPC ..... *H04R 1/1066* (2013.01); *H04R 1/1075* (2013.01); *H04R 2420/09* (2013.01)

(58) Field of Classification Search
CPC .. H04R 1/1066; H04R 1/1008; H04R 1/1075; H04R 5/0335; A61F 11/14
USPC ..... 381/74, 378, 379, 376, 278, 279, 381, 381/150, 370, 387
See application file for complete search history.

(56) References Cited

U.S. PATENT DOCUMENTS

| | | | | | |
|---|---|---|---|---|---|
| 4,517,418 | A * | 5/1985 | Baran et al. | 381/378 |
| 4,597,469 | A * | 7/1986 | Nagashima | 181/129 |
| 4,609,786 | A * | 9/1986 | Omoto et al. | 381/383 |
| 4,875,233 | A * | 10/1989 | Derhaag et al. | 379/430 |
| 5,035,005 | A * | 7/1991 | Hung | 2/209 |
| 5,835,609 | A * | 11/1998 | LeGette et al. | 381/385 |
| 5,983,399 | A * | 11/1999 | Falco et al. | 2/209 |
| 6,021,526 | A * | 2/2000 | Falco et al. | 2/209 |
| 6,148,446 | A * | 11/2000 | Leight | 2/209 |
| 6,195,839 | B1 * | 3/2001 | Patterson et al. | 16/334 |
| 6,305,026 | B1 * | 10/2001 | Mo | 2/209.13 |
| 6,377,684 | B1 * | 4/2002 | Lucey et al. | 379/430 |
| 6,382,213 | B1 * | 5/2002 | Sanpei | 128/864 |
| 6,385,325 | B1 * | 5/2002 | Nageno et al. | 381/374 |
| 6,427,018 | B1 * | 7/2002 | Keliiliki | 381/381 |
| 6,611,963 | B2 * | 9/2003 | Woo et al. | 2/209 |
| 6,638,295 | B1 * | 10/2003 | Schroer | 606/204.15 |
| 6,654,966 | B2 * | 12/2003 | Rolla | 2/209 |
| 6,993,143 | B2 * | 1/2006 | Harris et al. | 381/379 |
| 7,050,598 | B1 * | 5/2006 | Ham | 381/381 |
| 7,072,483 | B2 * | 7/2006 | Lenhard-Backhaus | 381/383 |
| 7,099,464 | B2 * | 8/2006 | Lucey et al. | 379/430 |
| 7,172,052 | B2 * | 2/2007 | Lenhard-Backhaus | 181/129 |

(Continued)

FOREIGN PATENT DOCUMENTS

WO WO 2007/103561 A2 * 9/2007 ..... H04R 5/02

*Primary Examiner* — Lun-See Lao
(74) *Attorney, Agent, or Firm* — Ganz Pollard LLC

(57) ABSTRACT

A headphone includes a pair of right and left headphone units, a resilient band formed substantially into a U shape to be mounted on a human head, and a pair of arm members. Each of the arm members is rotatably coupled via a pivot joint to an end part of the band and supporting one the headphone units. Each of the pivot joints includes a detent hinge for locking into a plurality of rotational positions an arm member relatively to the corresponding end part of the band.

22 Claims, 7 Drawing Sheets

(56) References Cited

U.S. PATENT DOCUMENTS

| | | | | |
|---|---|---|---|---|
| 7,245,737 | B2 * | 7/2007 | Amae et al. | 381/374 |
| 7,346,180 | B2 * | 3/2008 | Ham | 381/381 |
| 7,406,172 | B2 * | 7/2008 | Amae | 379/430 |
| 7,580,539 | B2 * | 8/2009 | Tachikawa | 381/374 |
| 7,650,649 | B2 * | 1/2010 | Le Gette et al. | 2/209 |
| 7,720,246 | B2 * | 5/2010 | Wang et al. | 381/383 |
| 7,940,924 | B2 * | 5/2011 | Amae | 379/430 |
| 7,962,970 | B2 * | 6/2011 | Le Gette et al. | 2/209 |
| 8,055,006 | B2 * | 11/2011 | Santiago | 381/379 |
| 8,605,935 | B1 * | 12/2013 | Huang | 381/381 |
| 2002/0009191 | A1 * | 1/2002 | Lucey et al. | 379/430 |
| 2003/0002706 | A1 * | 1/2003 | Keliiliki | 381/381 |
| 2003/0182713 | A1 * | 10/2003 | Rolla | 2/209 |
| 2004/0216946 | A1 * | 11/2004 | Lenhard-Backhaus | 181/129 |
| 2005/0053255 | A1 * | 3/2005 | Harris et al. | 381/379 |
| 2005/0226452 | A1 * | 10/2005 | Amae et al. | 381/381 |
| 2006/0001307 | A1 * | 1/2006 | Embach | 297/391 |
| 2006/0062417 | A1 * | 3/2006 | Tachikawa | 381/378 |
| 2007/0036386 | A1 * | 2/2007 | Amae | 381/388 |
| 2007/0154051 | A1 * | 7/2007 | Wang et al. | 381/384 |
| 2007/0258614 | A1 * | 11/2007 | Langberg | 381/379 |
| 2008/0056525 | A1 * | 3/2008 | Fujiwara et al. | 381/374 |
| 2009/0175481 | A1 * | 7/2009 | Amae | 381/375 |
| 2009/0220118 | A1 * | 9/2009 | Meier et al. | 381/379 |
| 2009/0285435 | A1 * | 11/2009 | Nelson et al. | 381/378 |
| 2010/0067714 | A1 * | 3/2010 | Cheng | 381/74 |
| 2010/0177907 | A1 * | 7/2010 | Morisawa | 381/74 |
| 2011/0002478 | A1 * | 1/2011 | Pollard et al. | 381/74 |
| 2011/0103635 | A1 * | 5/2011 | Asakura et al. | 381/378 |
| 2011/0116674 | A1 * | 5/2011 | Asakura et al. | 381/378 |
| 2011/0209273 | A1 * | 9/2011 | Fountain et al. | 2/423 |
| 2012/0052924 | A1 * | 3/2012 | Cybart et al. | 455/569.1 |
| 2012/0082333 | A1 * | 4/2012 | Amae | 381/375 |
| 2012/0140973 | A1 * | 6/2012 | Olodort et al. | 381/375 |

* cited by examiner

HEADPHONE

CROSS-REFERENCE TO RELATED APPLICATION

This application is a Non-Provisional Application of U.S. Provisional Patent Application 61/292,159, filed on Jan. 4, 2010 entitled "Headphone" which is hereby incorporated by reference herein in its entirety.

TECHNICAL FIELD

This invention generally relates to headphones and, more specifically, to a compact foldable headphone with rotatable earphone units.

BACKGROUND OF THE INVENTION

Commercially available headphones typically comprise a pair of earphones, coupled to one another by a resilient curved band for pressing the earphones against the ears of a user. The resilient band can be a headband type supported by the user's head, and a neckband type that presses down on the rear of the head of the user.

Among the commercially available headband type headphones, a few of them can be folded into a compact form when not in use. Once such headphone, disclosed within U.S. Pat. No. 7,172,052 B2, to Hugo Lenhard-Backaus, issued on Feb. 6, 2007, includes a headband and two earpieces each connected to the headband so as to be pivotable about at least two pivot axes. The two pivot axes intersect one another at a point of intersection that is positioned on or near a central axis of the earpiece, respectively. Arms connect the earpieces to the headband, wherein the arms define a first one of the two pivot axes, respectively. A second one of the two pivot axes is fixedly arranged on the headband, respectively. In this way, the earpieces are rotatable about the arms and the arms are rotatable relative to the headband about the second pivot axes. U.S. Pat. No. 7,172,052 B2, is incorporated herein by reference for at least the purpose of giving context to the present invention.

U.S. Pat. No. 7,188,896 B2, to James T. Embach, is directed to a headphone structure and storage thereof. The headphone structure concept provided includes headphones with rotatable earphones to provide a slimmer profile for storage. Each of the earphones is rotatable between a use position, in which the earphone is sufficiently positioned for listening use by a person wearing the headband, and a stored position. The headphone may have a first width or dimension when the earphone is in the use position and a second lesser width or dimension when the earphone is in the stored position. U.S. Pat. No. 7,188,896 B2 is incorporated herein by reference for at least the purpose of giving context to the present invention.

However, none of the prior headphones is configured so that the two earphones can be rotated or swiveled to a position away from the user's ear while the headphone is worn by the user. Therefore, there exists a need for a headphone that allows a user to free up or uncover one or both ears without removing the headphone from the user's head for greater artistic freedom and flexibility.

SUMMARY OF THE INVENTION

The present invention is defined by the appended claims. This description summarizes some aspects of the present embodiments and should not be used to limit the claims.

The foregoing problems are solved and a technical advance is achieved by a system, method, and articles of manufacture consistent with the present invention, which provides a headphone having rotatable earphones that can swivel to a position away from the user's ear while the headphone is on the user's head.

One embodiment of the present invention is directed to a headphone, which includes a pair of right and left headphone units, a resilient band formed substantially into a U shape to be mounted on a human head, and a pair of arm members. Each of the arm members is rotatably coupled via a pivot joint to an end part of the band and supporting one the headphone units. Each of the pivot joints includes a detent hinge for locking into a plurality of rotational positions an arm member relatively to the corresponding end part of the band. A first rotational position corresponds to the arm member being housed within the internal space formed by the band when the headphone in not mounted on the head. A second rotational position corresponds to the arm member being locked into a rearward facing position with respect to the head when the headphone is mounted on the head.

Other articles of manufacture, features, and advantages of the present invention will be, or will become, apparent to one having ordinary skill in the art upon examination of the following drawings and detailed description. It is intended that all such additional articles of manufacture, features, and advantages included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

Figure 2:
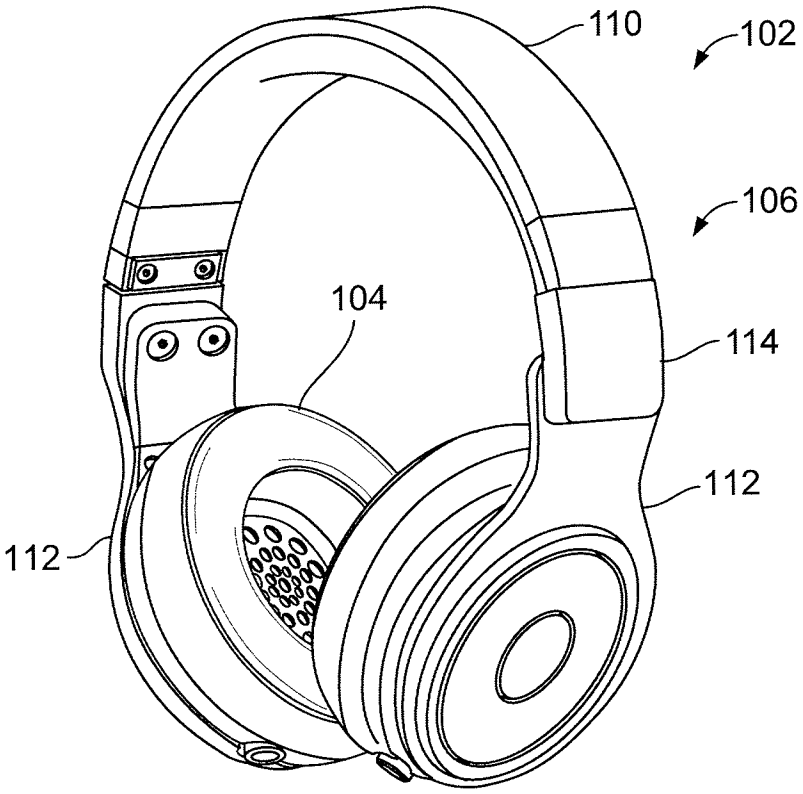
FIG. 2 is a perspective view of the headphone of FIG. 1.

Illustrative and exemplary embodiments of the invention are described in further detail below with reference to and in conjunction with the figures.

DETAILED DESCRIPTION OF THE DRAWINGS

The present invention is defined by the appended claims. This description summarizes some aspects of the present embodiments and should not be used to limit the claims.

While the present invention may be embodied in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects.

Figure 8A:
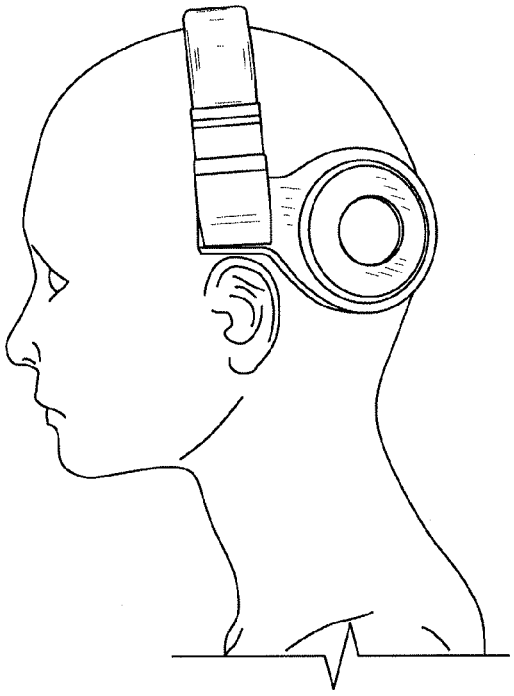
FIGS. 8 A-B are side views of the headphone of FIG. 1 being worn by a person, with one of the earphone units shown swiveled toward the back of the person's head in accordance with the present invention.
Figure 8B:
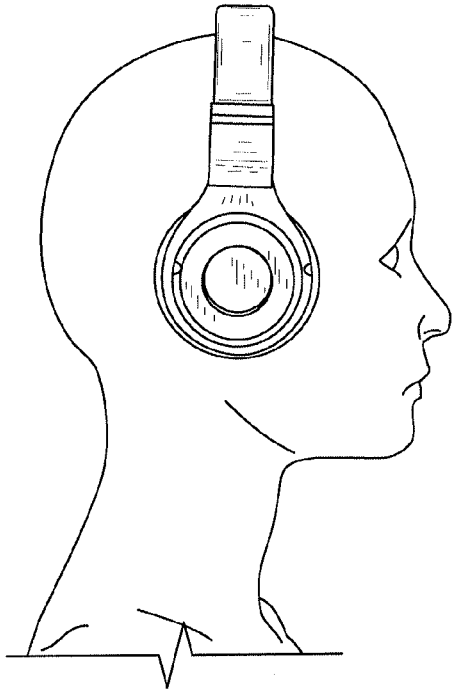

FIGS. 1-5 illustrate a plurality of views of an embodiment of a headphone 102 in accordance with the present invention. The headphone 102 includes a pair of headphone units 104, 104 which are interconnected by a substantially U-shaped or C-shaped flexible or elastic and resilient headband assembly 106. The headband assembly 106 has an adjustable curvature so as to be arranged along the top of the head of the user or wearer, and when mounted ranges from the wearer's head's crown to both sides of the head, as shown in FIGS. 8 A - B. The headband assembly 106 includes a headband 110 and two bow-shaped arms 112, to each one of which one of the headphone units 104 is pivotally attached. The headband assembly 106 includes a pair of sliding members 114, each having an extension 115 that can slide internally and relatively to one end of the headband 110. The headband 110 and the pair of sliding members 114 are coupled via a friction-based adjust mechanism, generated by external surfaces of the extensions 115 and corresponding internal surfaces of a channel (not shown) formed internally to the headband 110. Oppositely to the headband 110, one of the arms 112 is rotatably attached to one of the sliding members 114.

The friction-based adjust mechanism, provided at both ends of the headband 110, is a mechanism for adjusting the size of the headphone 102 so as to adapt to the size of the wearer's head. To that end, the sliding members 114 are formed so as to create a biasing frictional force when they are slid relatively to the headband 110. Before the headphone 102 is fitted onto the wearer's head, each of the extensions 115 can be substantially hidden within the corresponding channel. In this position, the distance between each of the headphone units 104 and the apex of the headband 110 is minimal, thus corresponding to the smallest head size that can comfortably accept or wear the headband 110. When the wearer puts on the headphone 102 by holding the earphone units 104 in his/her hands, he/she can adjust the headphone 102 by simply applying a force slightly greater than the frictional forces exerted by the sliding members 114 onto the channel to slide down the earphone units 104 towards his/her ears.

Figure 7:
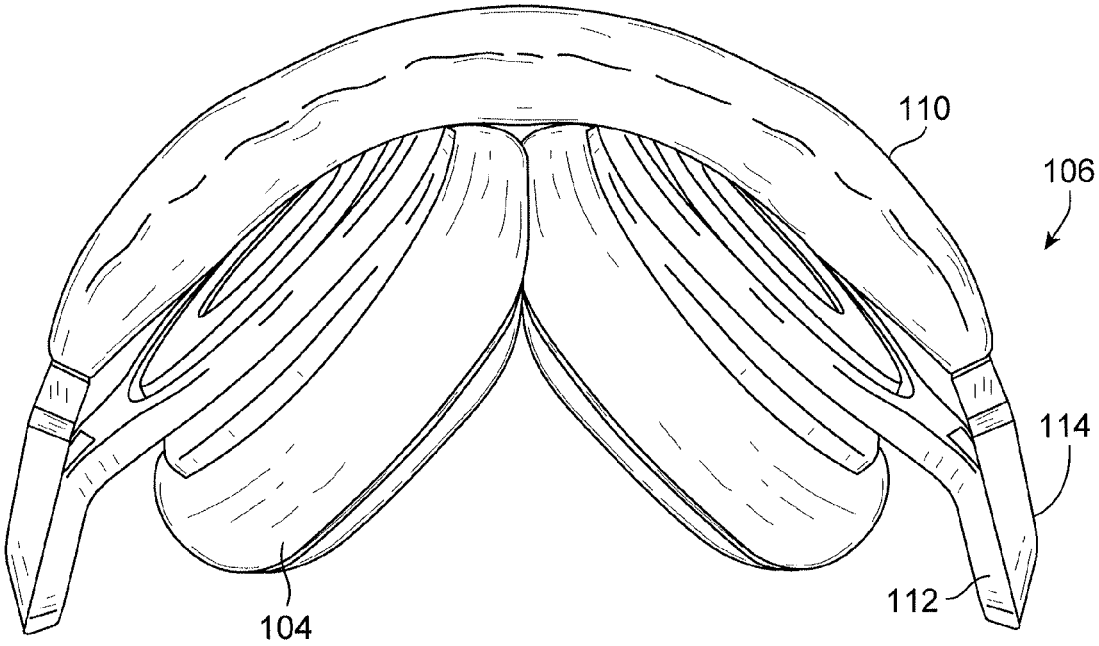
FIG. 7 is front view of the headphone of FIG. 1 with the earphones folded in the space underneath the headband in accordance with the present invention.

As shown in FIGS. 7 and 8 A-B, in accordance with the present invention, when the headphone 102 is not in use, the arms 112 and their associated headphone units 104 can be rotated to be housed in the internal space formed by the headband 110. Moreover, when the headphone 102 is in use, the arms 112 can be swiveled or flipped up to a position away from the wearer's ear. To accomplish these rotations of the arms 112 with respect to the headband 110, a pivot joint 116 couples rotatably the arms 112 to the headband 110. As shown in FIGS. 9-12 A-B, to provide a rotational position locking feature and a desirable rotating friction of one of the arms 112 with respect to one of the sliding members 114, the pivot joint 116 includes a detent hinge 118 and a friction hinge 120, both of which are substantially centered on the axis of rotation of one of the arms 112 with respect to an end part of the corresponding sliding members 114. Each detent hinge 118 releasably retains or locks the corresponding arm member 112 in a predetermined position relative to the headband 110 when the arm member 112 is rotated. Alternately, the pivot joint 116 may include a detent hinge only, a friction hinge only, or any other suitable hinge that facilitates the rotation of the arm members 112 relative to the headband 110, and the locking of the arm members 112 in desirable positions relative to the headband 110.

Figure 9:
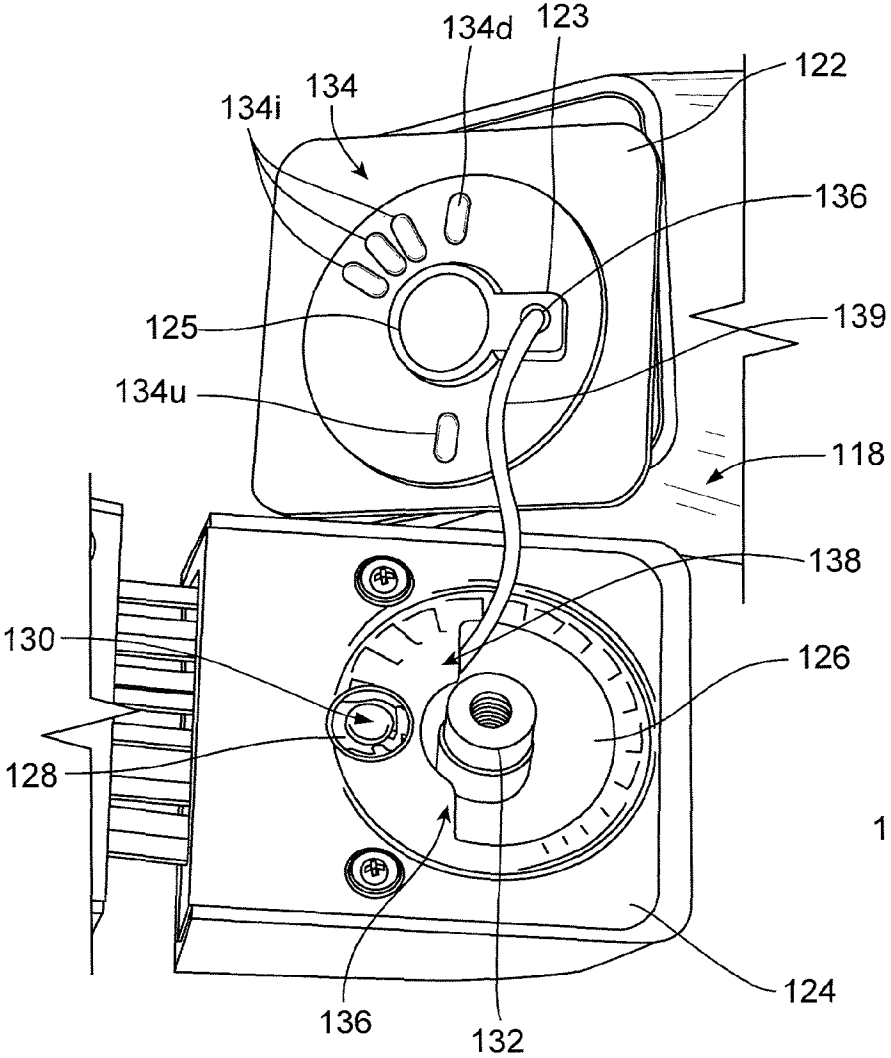
FIG. 9 illustrates a view of the main elements of a detent hinge coupling the headband to one the arm members in accordance with the present invention.
Figure 12A:
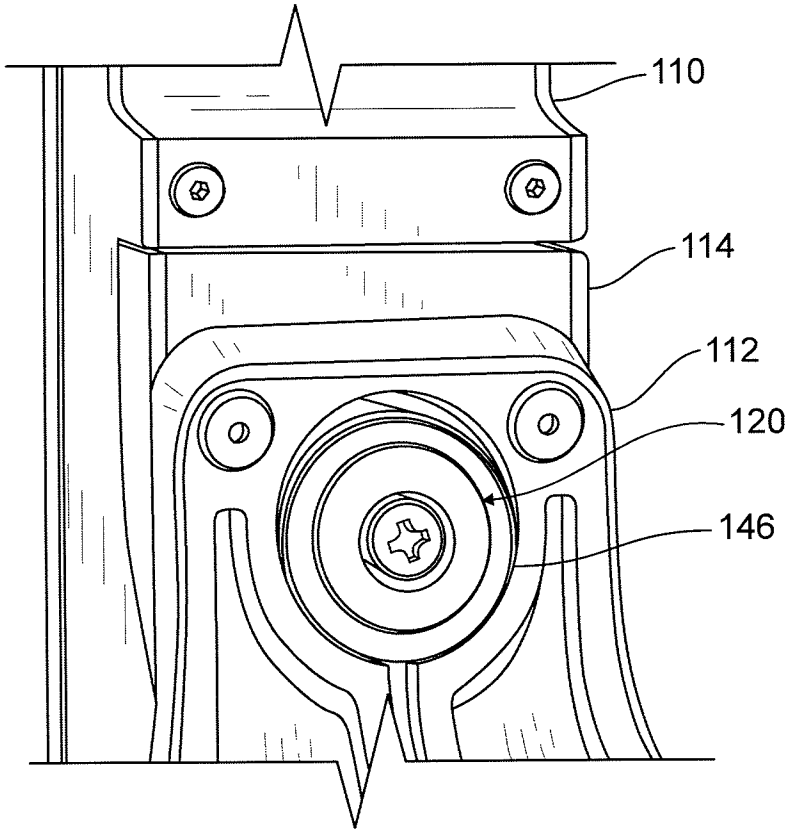
FIGS. 12 A-B illustrate an embodiment of a friction hinge associated with the detent hinge of FIG. 9 and a plurality of washers that form the friction hinge.

Now referring to FIG. 9, the detent hinge 118 comprises two opposing faces, a detent face 122 and a ball and spring face 124, which are pressed together by force of at least one spring washer of the friction hinge 120, shown in FIG. 12 A and to be discussed in detail hereafter. The ball and spring face 124, which is affixed to one end of the arms 112, includes a crescent-shaped opening 126 and a circular opening 128 for accepting a portion of a detent ball 130 therethrough. The crescent-shaped opening 126 includes a screw boss 132 for accepting a screw (not shown) to attach one of the arm 112 to the headband 110. The detent face 122, which is affixed to the headband 110 via a couple of screws, includes an opening 125 for accommodating therethrough the screw boss 132, and a plurality of detents 134 that can be engaged by the ball 130. The plurality of detents 134 defines a set of repeatable "soft stop" positions for the detent ball 130. The plurality of detents 134 includes an "all-the-way-down" detent **134*d* for locking the corresponding arm 112 into an in-line arrangement with the headband 110, and an "all-the-way-up" detent 134*u* for locking the corresponding arm 112 in the internal space formed by the headband 110. The crescent-shaped opening 126 includes a couple of diametrically opposite stops 136 and 138, which correspond to the "all-the-way-down" detent 134*d* and the "all-the-way-up" detent 134*u*, respectively. The detent face 122 further includes intermediate detents 134*i* situated between "all-the-way-down" detent 134*d* and the "all-the-way-up" detent 134*u*, which enables the corresponding arm 122 to be locked in place at intermediate positions. The detent face 122 further includes a hard-stop 123 extending radially away from the opening 125, and which includes a wire hole 136 for enabling an electric wire 139, connected to a transducer (not shown) of a corresponding earphone unit 104, to pass through the crescent-shaped opening 126 towards the other earphone unit 104 via the headband 110. The hard-stop 123 is configured to bump against the couple of diametrically opposite stops 136 and 138 when the arm 112 is rotated relatively to the headband 110 to define the "all-the-way-up" position and the "all-the-way-down" position of the arm 112**, respectively.

Figure 10:
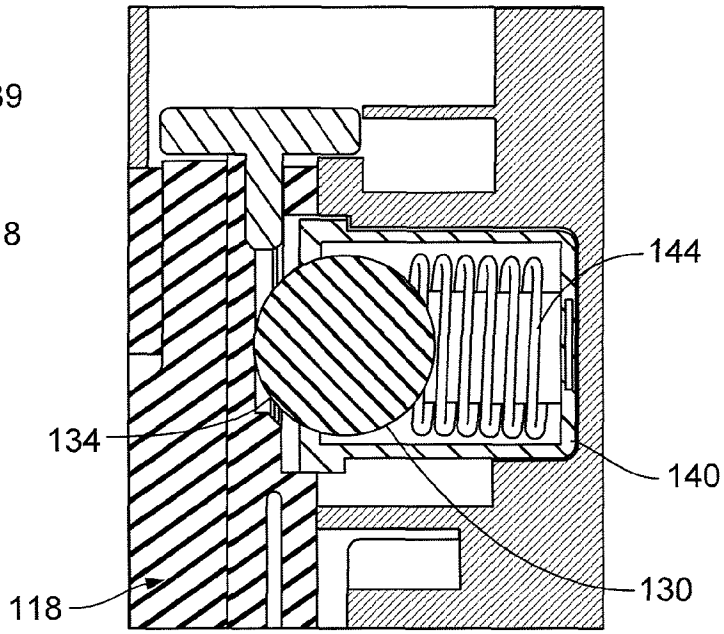
FIG. 10 illustrates a cross-sectional view of a detent hinge of FIG. 9.
Figure 11:
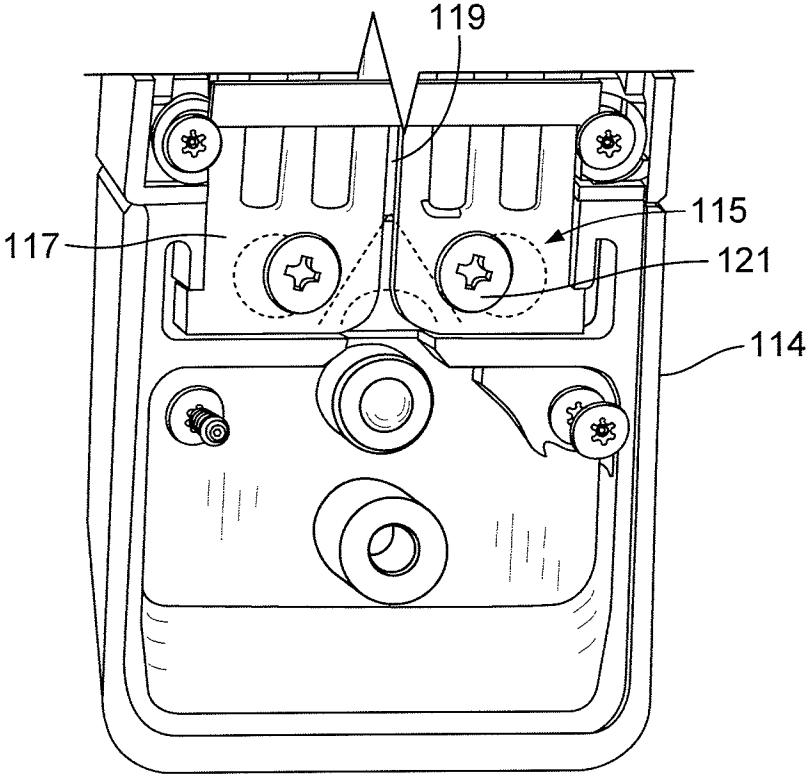
FIG. 11 illustrates an exposed view of a headband end which includes the ball side of the detent hinge of FIG. 9.

Now referring to FIG. 10, a cross-sectional view of the detent hinge 118 is shown. As illustrated, the detent ball 130, located within a hole 140, is biased against the narrow opening 128 by a spring 144 to engage as deep as possible one of the plurality of detent 134 when the two faces 122 and 124 are pressed against each other by the force of a spring washer assembly 146, shown in FIGS. 12 A-B. In FIG. 11, one end of one of the sliding members 114 is shown with the ball and spring face 124 removed. As illustrated, the sliding extension 115 is formed of two die-cast longitudinal pieces 117 separated by a groove 119, through which runs the electric wire 138. The two die-cast pieces 117 are each securely attached to the corresponding arm 112 by a screw 121. Although, the detent face 122 and the ball and spring face 124 are affixed to one end of the headband 110 and to the arm 112, respectively, in an alternate embodiment the two faces 122 and 124 can have their locations swapped.

Figure 12B:
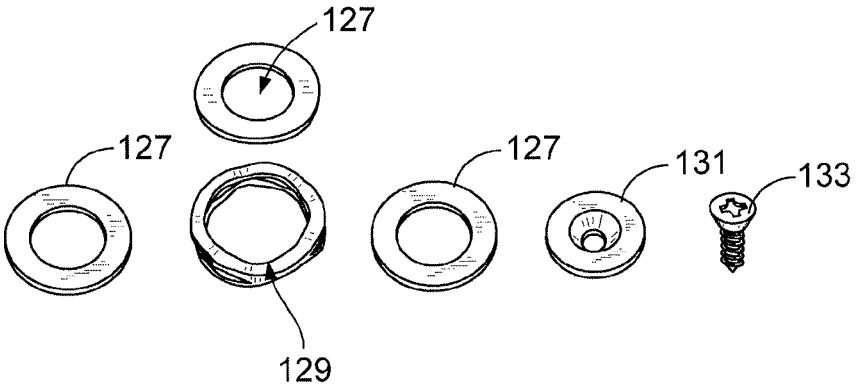

Now referring to FIG. 12 A, an embodiment of a friction hinge 120 is shown along with the spring washer assembly 146, which includes a plurality of washers 127, 129, 131 and a screw 133. The friction hinge 120 is positioned opposite the detent hinge 118 with respect to the carrying arm 112. As shown in FIG. 12B, the friction hinge 120 includes a plurality of regular flat washers 127, a spring washer 129 and a stepped washer 131 which accommodates screw 133 that engages screw boss 132, thereby rotatably securing the arm 112 to one end of the extension 114. The spring washer 129 is configured to provide, in conjunction with the other flat washers 127, the desired friction to the pivot joint 116, when pressed in place by the screw 133. In accordance with the present invention, the detent hinge 118 is configured to be strong enough to hold the weight of a headphone unit 114, even without friction, and the combination of the detent hinge 118 and the friction hinge 120 is configured to provide some protection factor for tolerance and wear.

Figure 13:
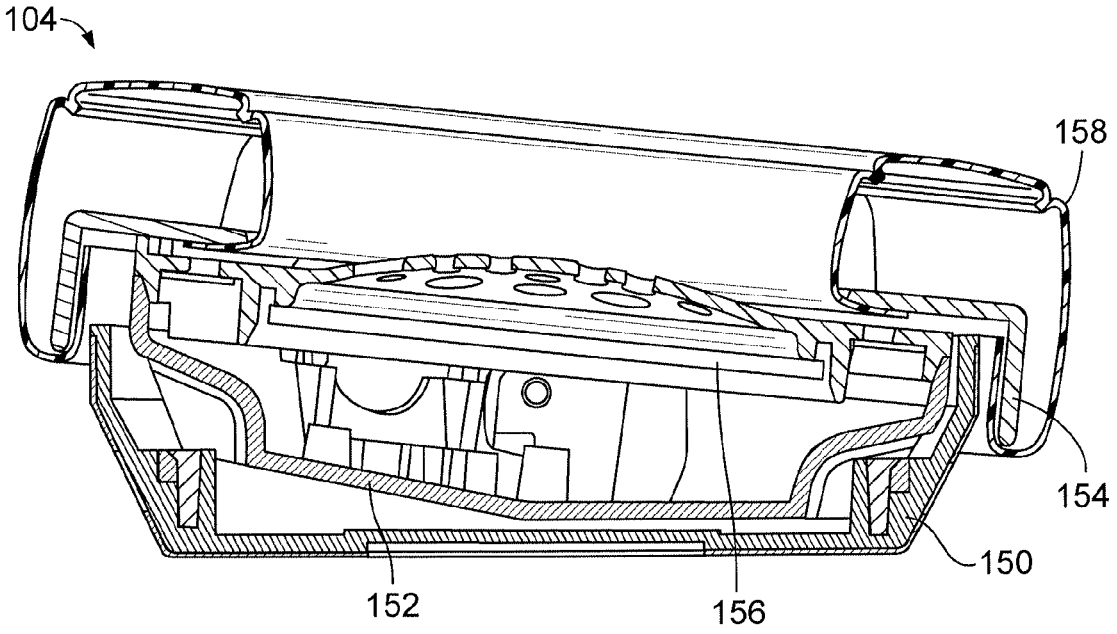
FIG. 13 illustrates a cross-sectional view of an earphone unit in accordance with the invention.

Now referring to FIG. 13, a cross-sectional view of an embodiment of an earphone unit 104 is shown. The earphone unit 104 has a casing or outer cup 150 which has a substantially disc-shaped outline, an inner cup 152, and an ear cup 154. The earphone unit 104 is pivotally attached to the corresponding arm 112 via a couple of pivot supports (not shown) positioned on an internal surface of an opening formed in the arm 112. The pivot supports are diametrically positioned to allow a pivoting of the earphone unit 104 along an axis that is substantially perpendicular to the longer side of the arm 112. The inner cup 152 is pivotally mounted to the outer cup 150 along a pivot axis that is substantially orthogonal to the pivoting axis of the outer cup 150, thereby enabling the inner cup 152 to substantially pivot about tow orthogonal axes with respect to the arm 112. As shown in FIG. 13, the inner cup 152 includes a the transducer 156 for converting an electrical signal into sound, and on the sound radiating side the ear cup 154 is wrapped circumferentially by a cushioning doughnut-shaped ear pad 158. Due to the two pivot axes and the bow shape of the arm 112, when the headphone 102 is mounted on the wearer's head each of the earphone units 104 is completely self-adjustable with respect tom the wearer's ear to become substantially parallel to the ear, thereby adopting an optimum position which minimizes the travel of the sound outside the ear pad 158. As such, the cushioned headphone units 104 provide very comfortable listening and superior passive sound isolation.

As stated above, the arm 112 is rotatable about the pivot joint 116 whose axis of rotation is substantially perpendicular to the detent face 122 of the end of the headband 110, which faces the internal space formed by the headband 110. When the headphone 102 is mounted on a wearer's head, the wearer can swivel each of the headphone unit 114 backward or rearward from an ear-covering position to positions away from the wearer's ear. These rearward positions of the headphone unit 104 can be predetermined by judicious locations of the intermediate detents 134*i* on the detent face 122. As the wearer's head typically falls away to the rear, the bow shape of the arm 112 combined with the pivotable and pad-cushioned features of the earphone unit 104 enables the headphone unit 104 to follow the contour of the wearer's head in a virtually pressure-less manner. Preferably, one of the intermediate detents 134*i* is positioned substantially centrally between the "all-the-way-up" detent 134*u* and the "all-the-way-down" detent 134*d* to lock the arm 112, when swivel backwards, in a substantially perpendicular orientation to the headband 110.

Figure 1:
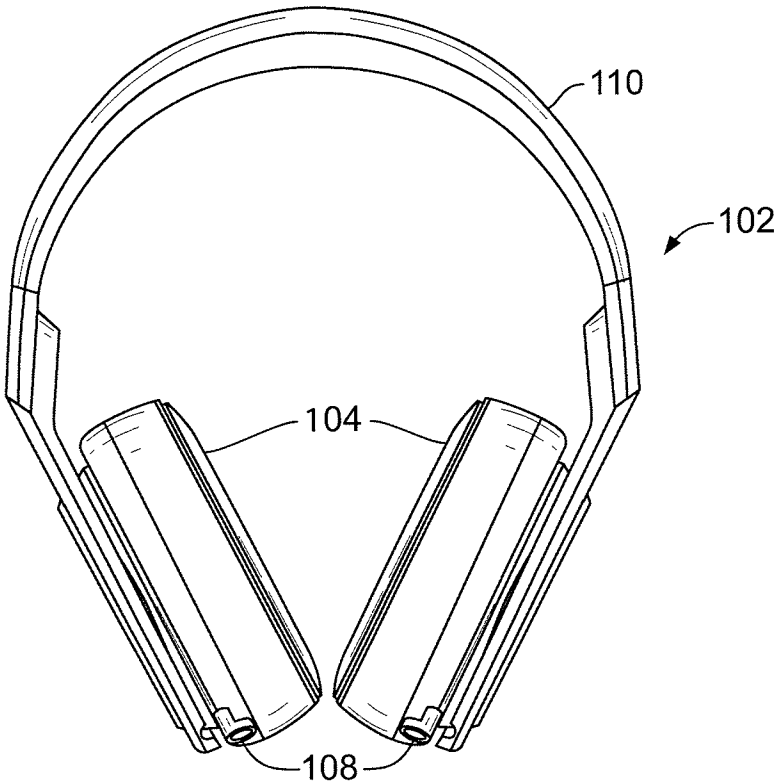
FIG. 1 is a front elevational view of an embodiment of a headphone in accordance with the present invention.
Figure 3:
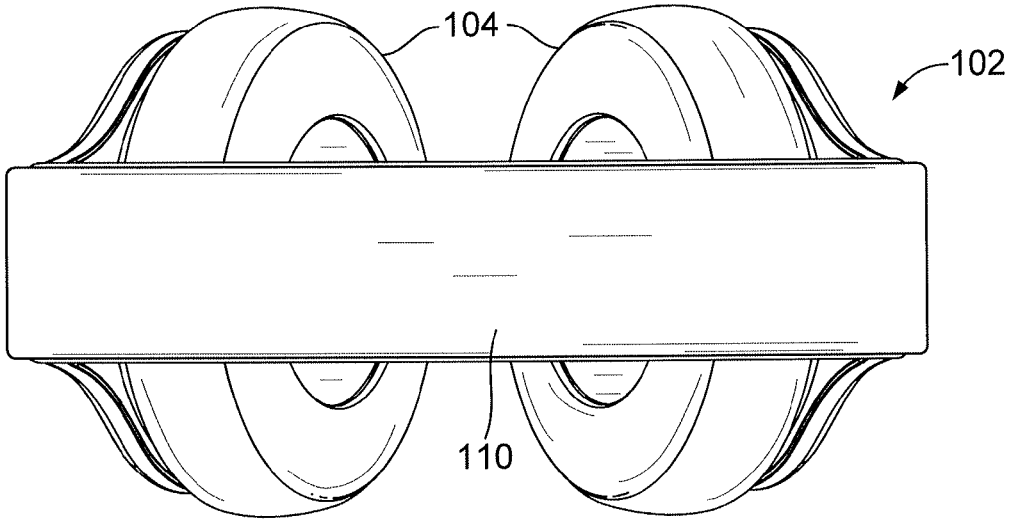
FIG. 3 is a top view of the headphone of FIG. 1.
Figure 4:
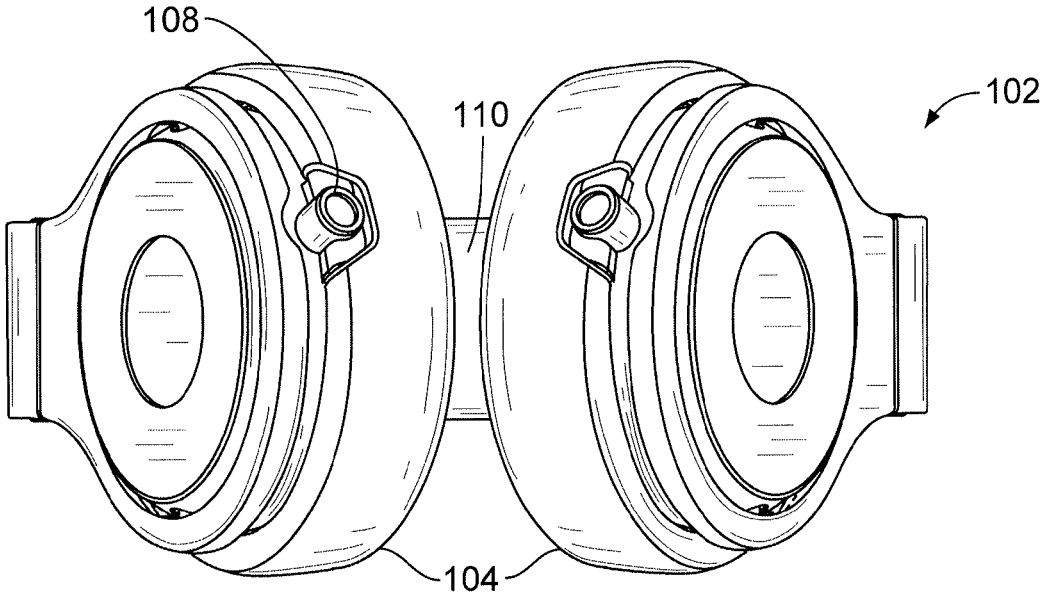
FIG. 4 is a bottom view of the headphone of FIG. 1.
Figure 6:
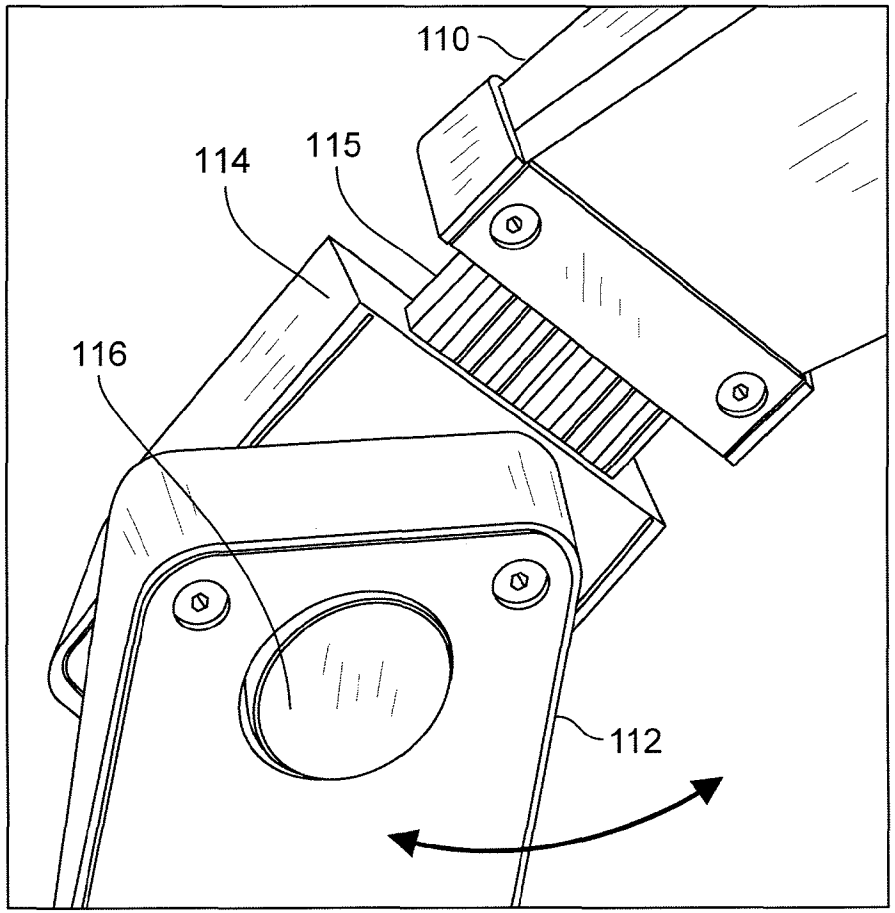
FIG. 6 is a perspective view of one of the arm members rotated and slid away relative to the headband in accordance with the present invention.
Figure 5:
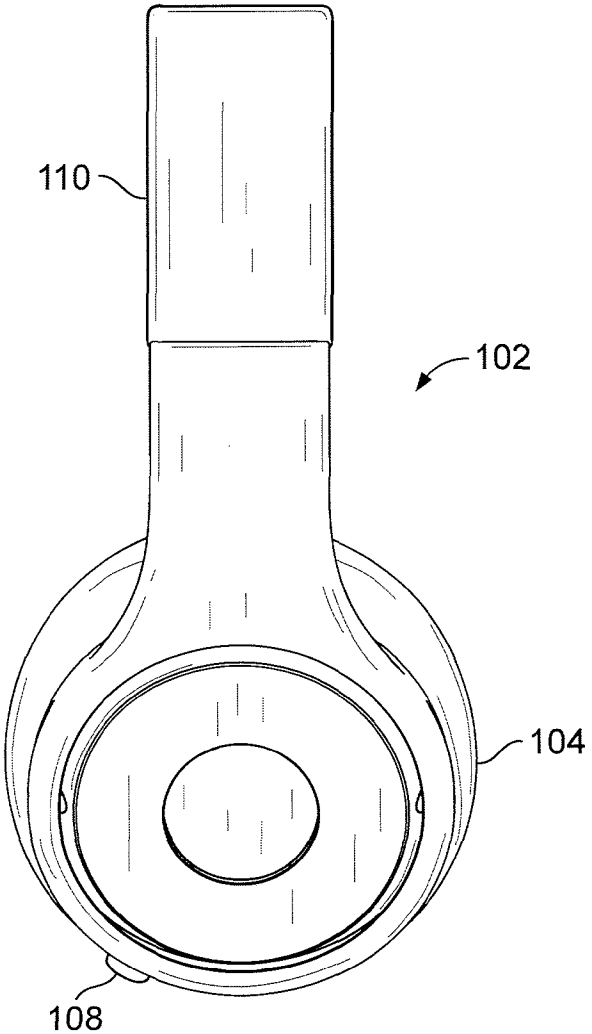
FIG. 5 is a side view of the headphone of FIG. 1.

As shown in FIGS. 1 and 2, each of the headphone units 104 includes a cable port 108. In accordance with the present invention, by plugging a headphone cable (not shown) into the cable port 108 of one the headphone units 104, the cable port 108 of the other headphone unit 104 automatically switches to output mode. As such, each cable port 108 is configured as an input/output cable port. By having dual input/output cable ports 108, the headphone 102 can be daisy-chained with any other headphone to share audio signals inputted from either one of the two headphone units 104. In practice, a second headphone wearer can plug his earphone cable into one cable port 108 operating in output mode to listen to the audio signal received by the cable port 108 operating in input mode.

Accordingly, the above discussed adjustable headphone 102 can be comfortably worn by the wearer for an extended listening period. This is achieved by headphone units 104, connected to a flexible headband, that automatically adjust, via a couple of pivoting axes, to achieve a comfortable and substantially pressureless precise fitting to the wearer's ear. The headphone units 104 flip-up to the rear of the head to allow for easy monitoring of outside environment by the wearer and for greater artistic freedom and flexibility, and this flip-up of the headphone units 104 is supported by a duo of hinges 118 and 120, detent and friction, which help maintain the headphone units 104 in any desirable rotational position relatively to the headband 110. The dual input/output cable ports 108 enable a daisy-chaining of the headphones 102. In addition, the headphone 102 is preferably constructed from strong yet lightweight aluminum, which help minimize vibrations, thereby minimizing unwanted audio artifacts. The plush cushioned earphone units 104 yield superior sound isolation with maximum comfort and minimal ear fatigue.

It should be emphasized that the above-described embodiments of the present invention, particularly, any "preferred" embodiments, are possible examples of implementations, merely set forth for a clear understanding of the principles of the invention. Many variations and modifications may be made to the above-described embodiment(s) of the invention without substantially departing from the spirit and principles of the invention. All such modifications are intended to be included herein within the scope of this disclosure and the present invention and protected by the following claims.

The invention claimed is:

1. A headphone comprising:

a resilient, curved band having opposed first and second end parts and an intermediate part positioned therebetween, wherein the band defines an interior region;

an arm member extending between a proximal end and a distal end;

an earphone unit physically coupled to the arm member adjacent the distal end thereof;

a pivot joint pivotally coupling a region adjacent the proximal end of the arm member with one of the opposed end parts of the band to define an axis of rotation oriented transversely relative to a wearer's head when the headphone is donned, wherein the pivot joint is configured to stop rotation of the arm member in a first direction at a first position and to stop rotation of the arm member in an opposed rotational direction at a second position substantially opposite the first position, and to inhibit rotation of the arm member at one or more intermediate positions between the first position and the second position.

2. A headphone according to claim 1, wherein the earphone unit comprises a first earphone unit, the headphone further comprising a second earphone unit positioned opposite the first earphone unit relative to the band.

3. A headphone according to claim 2, wherein the arm member comprises a first arm member, the headphone further comprising a second arm member pivotally coupled to the band, wherein the second earphone unit is physically coupled with the second arm member.

4. A headphone according to claim 1, wherein, in the first rotational position, the arm member is substantially aligned with the band and the earphone unit is in a distal-most rotational position relative to the band.

5. A headphone according to claim 1, wherein, in the second rotational position, the arm member is substantially aligned with the band and the earphone unit is positioned within the interior region of the band.

6. A headphone according to claim 1, wherein the pivot joint is further configured to inhibit rotation of the arm member in the first direction and the second direction at each of a plurality of discrete rotational positions between the first position and the second position.

7. A headphone according to claim 6, wherein the plurality of discrete rotational positions comprises a rotational position in which the arm member is substantially perpendicular to the band.

8. A headphone according claim 1, wherein the pivot join is further configured to continuously inhibit rotation of the arm member relative to the band.

9. A headphone according claim 6, wherein the pivot join is further configured to continuously inhibit rotation of the arm member relative to the band.

10. A headphone according to claim 1, wherein the band comprises a sliding member slidably coupling the arm member to the intermediate part of the band.

11. A headphone according to claim 1, wherein the sliding member is included in the corresponding end part of the band and at least partially defines a lower end of the interior region.

12. A headphone according to claim 11, further comprising extension portions slidably coupling the sliding member to an internal channel formed at the corresponding end of the intermediate part of the band.

13. A headphone according to claim 11, wherein the pivot joint rotatably couples the arm member to the sliding member in the end part of the band.

14. A headphone according to claim 1, further comprising a slidable member configured to slidingly couple the pivot joint to the respective one of the opposed end parts of the band.

15. A headphone comprising:

a resilient, curved band defining an interior region configured to receive a wearer's head;

a left earphone unit and a right earphone unit, each being rotatably coupled to the band; and a pivot joint corresponding to each earphone unit, wherein each pivot joint is configured to allow the respective earphone unit to rotate relative to the band in a first direction rearwardly of the wearer's corresponding ear from a first position corresponding to the wearer's ear when the headphone is worn, wherein each pivot joint is further configured to allow the corresponding earphone unit to rotate in the first direction to a second position positioned within the interior region, to inhibit rotation of the earphone unit at one or more selected rotational positions between the first position and the second position, and to prevent the respective earphone unit from rotating past the second position in the first direction and past the first position in a second direction opposite to the first direction.

16. A headphone unit according to claim 15, wherein each respective pivot joint is further configured to lock the corresponding earphone unit in one or more intermediate rotational positions between the first position and the second position.

17. A headphone unit according to claim 15, wherein the one or more intermediate rotational positions comprises a 90-degree rotational position.

18. A headphone unit according to claim 15, wherein each respective pivot joint is further configured to frictionally resist rotation of the corresponding earphone unit at the one or more selected rotational positions.

19. A headphone according to claim 15, further comprising a slidable coupler configured to slidingly couple the pivot joint to the band.

20. A headphone comprising:

a left earphone unit and a right earphone unit;

a resilient, substantially U-shaped band mountable on a human head and having a left arm corresponding to the left earphone unit and a right arm corresponding to the right earphone unit, and an intermediate portion extending between the left arm and the right arm, wherein the band defines an interior region;

a respective pivot joint defining a corresponding axis of rotation oriented to extend outwardly of the interior region of the U-shaped band, wherein each respective pivot joint is positioned between the intermediate portion and each of the left arm and the right arm, wherein each pivot joint is configured to prevent rotation of the respective arm relative to the intermediate portion in a first direction when the respective arm is positioned in the interior region defined by the band, and to prevent rotation of the respective arm relative to the intermediate portion in a second direction when the respective arm is substantially aligned with the intermediate portion, and to inhibit rotation of the respective arm at one or more discrete rotational positions.

21. A headphone according to claim 20, wherein each respective pivot joint is further configured to inhibit rotation of the respective arm continuously.

22. A headphone according to claim 20, further comprising a respective slidable coupler corresponding to each pivot joint and configured to slidingly couple the intermediate portion of the band to the respective pivot joint.

* * * * *